US009362069B1

(12) United States Patent
Lin

(10) Patent No.: US 9,362,069 B1
(45) Date of Patent: Jun. 7, 2016

(54) MULTI-COMMAND TRIGGER SWITCH

(71) Applicant: ZIPPY TECHNOLOGY CORP., New Taipei (TW)

(72) Inventor: Ching-Hsin Lin, New Taipei (TW)

(73) Assignee: ZIPPY TECHNOLOGY CORP., New Taipei (TW)

( * ) Notice: Subject to any disclaimer, the term of this patent is extended or adjusted under 35 U.S.C. 154(b) by 0 days.

(21) Appl. No.: 14/617,435

(22) Filed: Feb. 9, 2015

(51) Int. Cl.
*H01H 9/00* (2006.01)
*H01H 25/04* (2006.01)

(52) U.S. Cl.
CPC ..... *H01H 25/04* (2013.01); *H01H 2221/01* (2013.01)

(58) Field of Classification Search
CPC ..... H01H 25/04; H01H 2221/01; H01H 2221/008; H01H 19/14
USPC ..... 200/4, 11 R, 336, 5 R, 564, 570, 12–11 K
See application file for complete search history.

(56) References Cited

U.S. PATENT DOCUMENTS 5,369,230 A * 11/1994 Misawa ..... G03B 17/00 200/11 G
6,621,016 B2 * 9/2003 Ohba ..... H01H 25/041 200/11 R
7,145,087 B1 * 12/2006 Su ..... H01H 19/11 200/11 R
7,342,186 B2 * 3/2008 Montalvo ..... G05G 1/08 200/11 R
7,550,687 B2 6/2009 Su

* cited by examiner

*Primary Examiner* — Edwin A. Leon
(74) *Attorney, Agent, or Firm* — Muncy, Geissler, Olds & Lowe, P.C.

(57) ABSTRACT

A multi-command trigger switch includes a rotary switch, a rotary casing and a trigger element. The rotary switch includes a base and a rotary disc coupled with the base and movable on a swivel locus against the base. The base and the rotary disc are interposed by a housing space to hold a rotary trigger assembly and a depressing trigger assembly. The rotary trigger assembly outputs a first trigger signal while moving on the swivel locus. The depressing trigger assembly outputs a second trigger signal while moving on a vertical locus. The rotary casing and the rotary switch define a movement space therebetween to hold the trigger element. The base and the depressing trigger assembly confine movement of the depressing trigger assembly through a positioning notch and a confining rib. The depressing trigger assembly and the trigger element include confine the trigger element from rotating against the rotary casing.

11 Claims, 7 Drawing Sheets

MULTI-COMMAND TRIGGER SWITCH

FIELD OF THE INVENTION

The present invention relates to a multi-command trigger switch and particularly to a multi-command trigger switch that confines movement direction of a trigger element through a corresponding confining structure.

BACKGROUND OF THE INVENTION

Multi-command trigger switch has been widely used in various types of electronic products these days, such as computer keyboards, remote control devices and the like. For instance, U.S. Pat. No. 7,550,687 discloses a multi-command trigger switch 90, please referring to FIG. 1, that includes a rotary switch, a trigger element 8 and a rotary casing 9. When in use, by rotating the rotary casing 9 the rotary switch can be driven to move along a swivel locus to output a first trigger signal; and the trigger element 8 also can be depressed to make a vertical trigger switch on the rotary switch to output a second trigger signal. However, the aforesaid multi-command trigger switch 90 has the trigger element 8 and the vertical trigger switch coupled in a simple structure without confining the trigger element 8 in position, hence when the multi-command trigger switch 90 is used in an environment with great vibration the trigger element 8 is easily affected by shaking of external forces and skews from the rotary switch, and the indication marks printed on the trigger element 8 could be deviated from the original positions as shown in FIG. 1. This could confuse user's distinguishing of the indication marks. Moreover, the multi-command trigger switch 90 looks inferior in quality and could result in a lower esteem in user's mind.

SUMMARY OF THE INVENTION

The primary object of the present invention is to solve the problems of the conventional multi-command trigger switch resulted from no confining of the trigger element.

To achieve the foregoing object the present invention provides a multi-command trigger switch that includes a rotary switch, a rotary casing and a trigger element. The rotary switch includes a base and a rotary disc which is coupled with the base and movable on a swivel locus against the base. The base and the rotary disc are interposed by a housing space to hold a rotary trigger assembly and a depressing trigger assembly. The rotary disc has an installation orifice corresponding to the depressing trigger assembly and communicating with the housing space to hold the depressing trigger assembly. The rotary trigger assembly outputs a corresponding first trigger signal while the rotary disc is moving on the swivel locus. The depressing trigger assembly is independently located in the center of the rotary trigger assembly and in the installation orifice and is movable on a vertical locus against the base to output a second trigger signal. The rotary casing is coupled with the rotary switch and collaborated therewith to form a movement space between them. The rotary casing has an aperture corresponding to the movement space and has a latch portion corresponding to a latch trough formed on the rotary disc to form a latch relationship between them. The rotary casing can be rotated under an external force so that the latch portion and the latch trough jointly drive the rotary switch to move on the swivel locus. The trigger element is coupled on an upper side of the depressing trigger assembly and held in the aperture, and can be moved under a force in the movement space to drive the depressing trigger assembly to move on the vertical locus. The base and the depressing trigger assembly have respectively a positioning notch and a confining rib that correspond to each other and form a confining relationship to confine the depressing trigger assembly to move on the vertical locus in the installation orifice. The depressing trigger assembly and the trigger element also have respectively a confining portion and a coupling portion between them that correspond to each other and form a confining relationship to prohibit the trigger element from rotating against the rotary casing.

In one embodiment the depressing trigger assembly includes a trigger reed located on the base and can be triggered to generate the second trigger signal, and an action strut located in the housing space corresponding to the trigger reed to couple with the coupling portion of the trigger element through the confining portion.

In another embodiment the confining portion includes an assembly plane facing the trigger element and an assembly boss protruded from the assembly plane. The coupling portion includes an installation plane in contact with the assembly plane and a coupling recess indented against the installation plane to couple with the assembly boss. Furthermore, the confining portion further includes an assembly recess indented against the assembly plane and staggered radially against the assembly boss. The coupling portion includes a coupling boss protruded from the installation plane and staggered radially against the coupling recess and coupled with the assembly recess.

In yet another embodiment the confining portion includes an assembly plane facing the trigger element and an assembly recess indented against the assembly plane, and the coupling portion includes an installation plane in contact with the assembly plane and a coupling boss protruded from the installation plane to couple with the assembly recess. Furthermore, the confining portion further includes an assembly boss protruded from the assembly plane and staggered radially against the assembly recess. The coupling portion includes a coupling recess indented against the installation plane and staggered radially against the coupling boss to couple with the assembly boss.

In yet another embodiment the positioning notch is located on a detent wall of the base corresponding to the depressing trigger assembly, and the confining rib is located on the action strut.

In yet another embodiment the depressing trigger assembly is protruded from the rotary disc at a height to support the trigger element without in contact with the rotary disc.

In yet another embodiment the trigger element and the rotary casing form an allowance between them so that the rotary casing can be moved on the swivel locus without driving the trigger element.

In yet another embodiment the trigger element is located on the rim of the trigger element and formed at a diameter greater than the aperture so that the trigger element is confined by the detent portion in the movement space.

In yet another embodiment the rotary casing has an annular portion surrounding the aperture to define the movement space with the rotary disc.

By means of the structure set forth above, compared with the conventional techniques, the invention provides advantageous features as follows:

Through the positioning notch and the confining rib to collaborate with the confining portion and the coupling portion of the depressing trigger assembly and the trigger element, the trigger element can be confined to move merely on the vertical locus against the rotary switch without skewing under external forces, thus can resolve the problems resulted from no confining of the trigger element that occurred to the conventional multi-command trigger switches.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
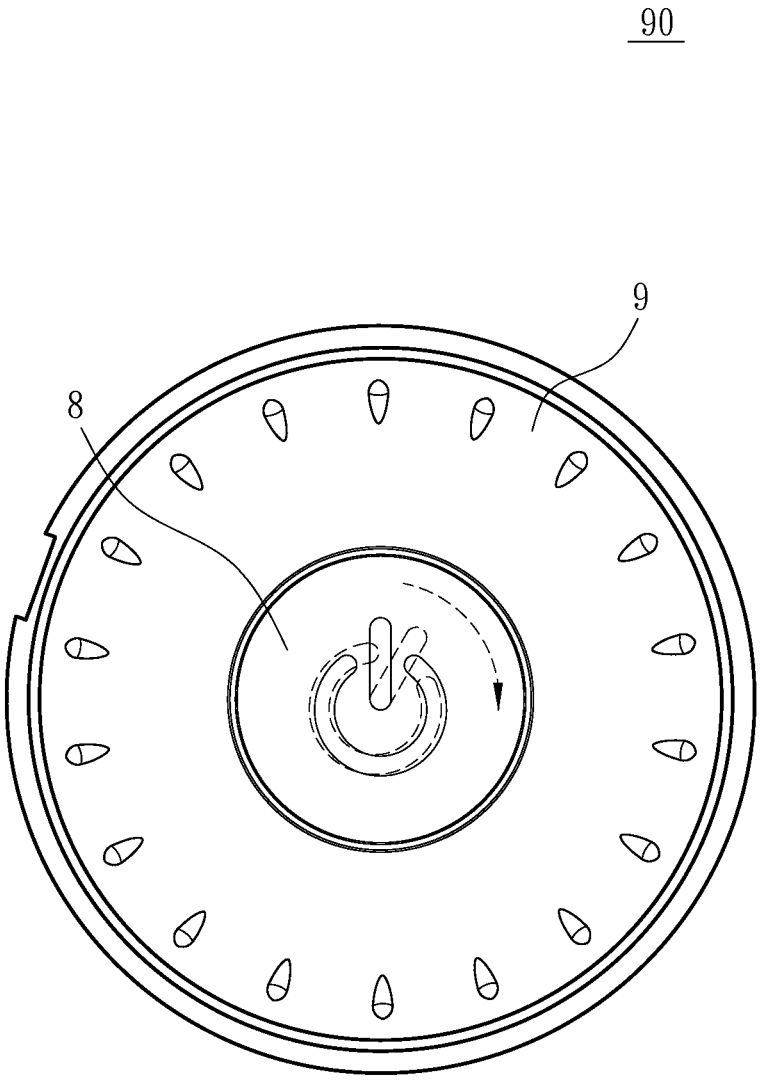
Fig. 1 PRIOR ART
FIG. 1 is a schematic view of a conventional multi-command trigger switch.
Figure 2:
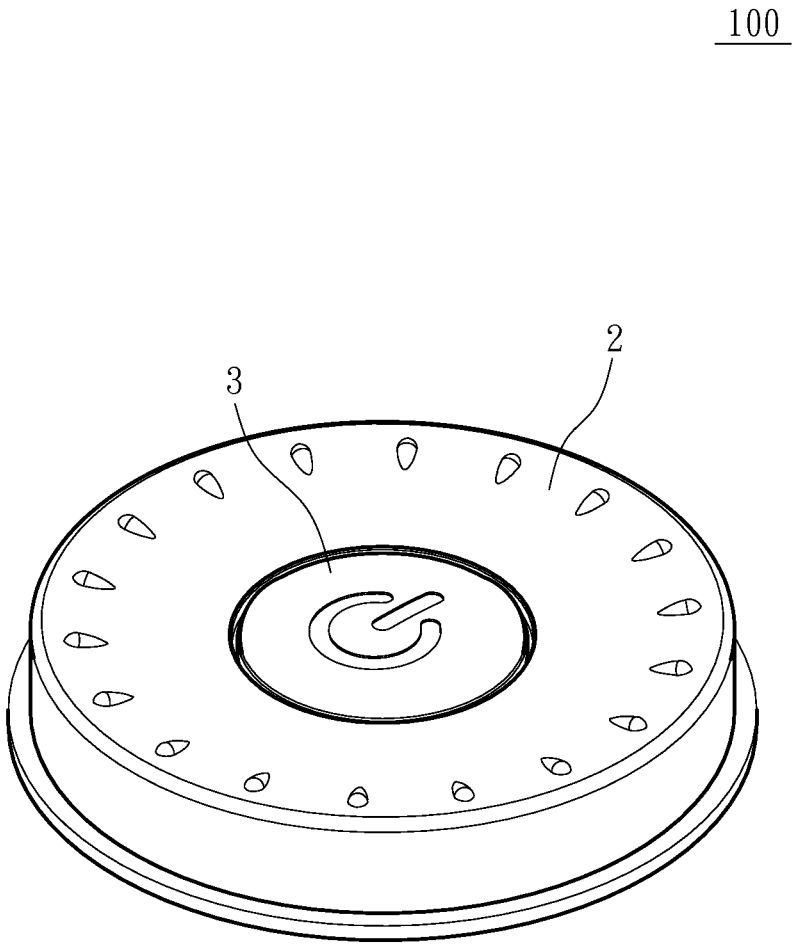
FIG. 2 is a perspective view of an embodiment of the multi-command trigger switch of the invention.

Please referring to FIGS. 2 through 5, the present invention aims to provide a multi-command trigger switch 100 that includes a rotary switch 1, a rotary casing 2 and a trigger element 3. More specifically, the rotary switch 1 includes a base 11 and a rotary disc 12 coupled with the base 11 and movable on a swivel locus against the base 11. The base 11 has an annular groove 111 formed on the perimeter. The rotary disc 12 has a coupling portion 121 to latch on the annular groove 111 so that the rotary disc 12 can be coupled at an upper side of the base 11 and also rotate against the base 11 via the annular groove 111 as a track. Moreover, the base 11 and the rotary disc 12 are interposed by a housing space 15 to hold a rotary trigger assembly 13 and a depressing trigger assembly 14. The housing space 15 can be formed by coupling a housing recess 112 formed on the base 11 and an assembly recess 122 formed on the rotary disc 12. The rotary trigger assembly 13 includes a leg connector 131 and a conductive element 132. The leg connector 131 is located on the base 11. The conductive element 132 is located on the rotary disc 12 and overlapped over the leg connector 131. Thus, when the rotary disc 12 is moved under an external force on the swivel locus the leg connector 131 and the conductive element 132 can make contact with each other to output a corresponding first trigger signal. In addition, the rotary disc 12 has an installation orifice 123 corresponding to the depressing trigger assembly 14 and communicating with the housing space 15 to hold the depressing trigger assembly 14. The depressing trigger assembly 14 is independently located in the center of the rotary trigger assembly 13 without forming electrical connection with the rotary trigger assembly 13. The depressing trigger assembly 14 is located in the installation orifice 123 and movable against the base 11 on a vertical locus. Also referring to FIG. 5, in one embodiment the depressing trigger assembly 14 includes a trigger reed 141 located on the base 11 and an action strut 142 located in the housing space 15 corresponding to the trigger reed 141 and overlapped therewith. When in use the trigger reed 141 is pressed by the action strut 142 to output a second trigger signal. More specifically, the depressing trigger assembly 14 can be moved against the base 11 on the vertical locus, and when the action strut 142 is pressed under a force to move on the vertical locus toward the trigger reed 141 the trigger reed 141 outputs the second trigger signal. When the force applied to the action strut 142 is absent the action strut 142 receives a return elastic force of the trigger reed 141 and returns to the condition before being pressed. In addition, the base 11 and the depressing trigger assembly 14 further are interposed by a positioning notch 113 and a confining rib 147 to confine the depressing trigger assembly 14 to move only on the vertical locus without swiveling against the base 11. In another embodiment the positioning notch 113 is located on a detent wall 114 on the base 11 corresponding to the depressing trigger assembly 14, and the confining rib 147 is located on the action strut 142.

Figure 3:
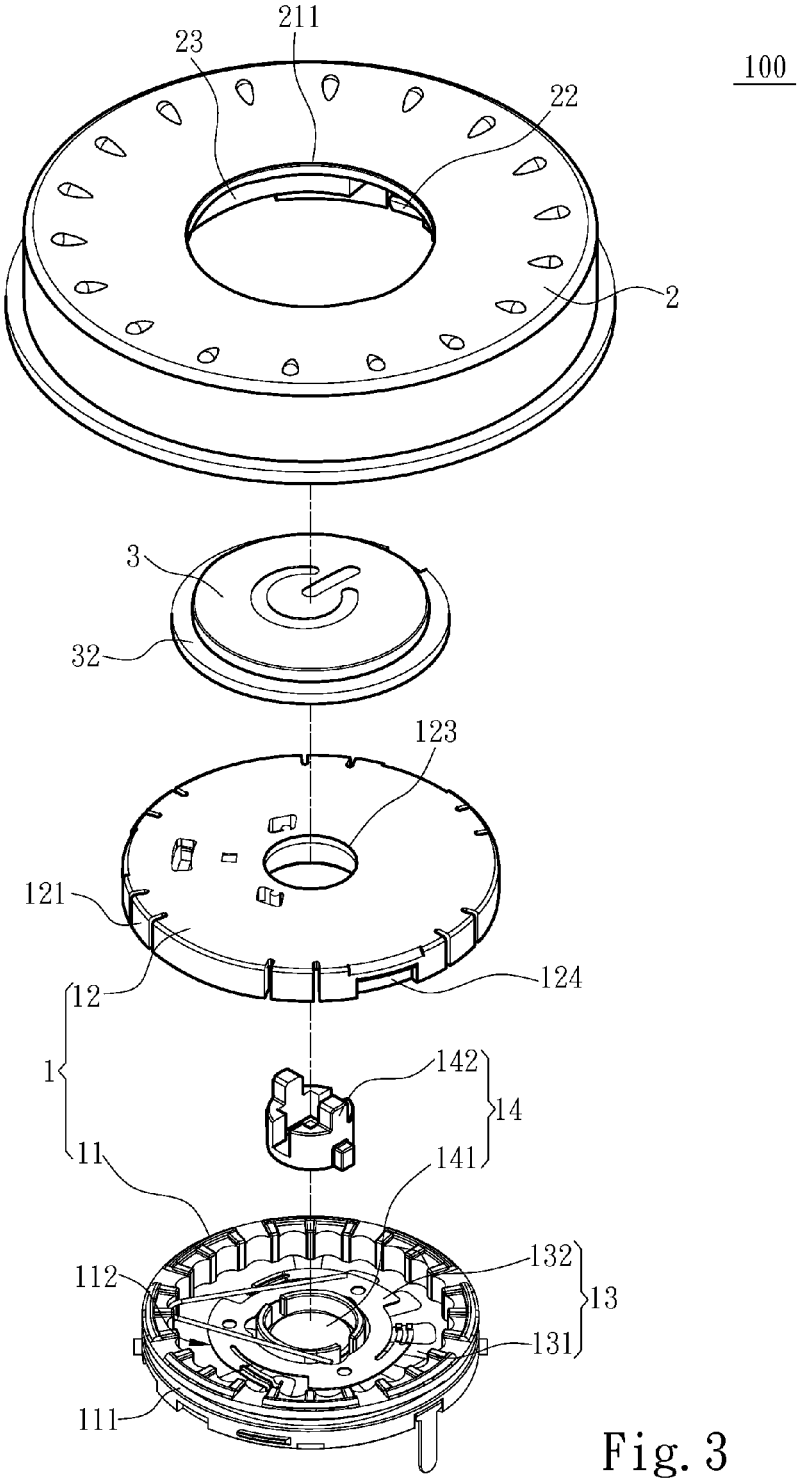
FIG. 3 is an exploded view of an embodiment of the multi-command trigger switch of the invention seen from a first visual angle.
Figure 4:
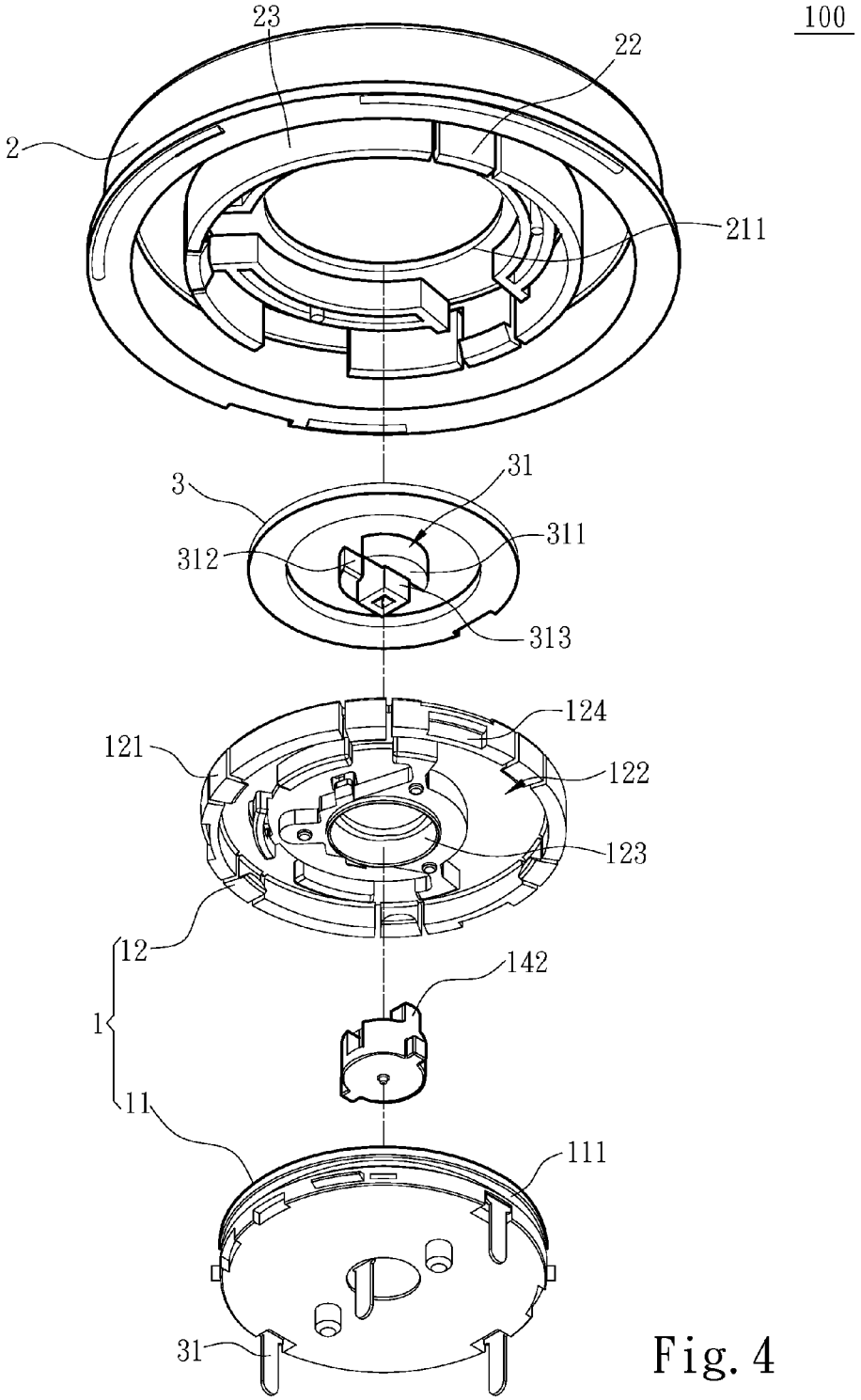
FIG. 4 is an exploded view of an embodiment of the multi-command trigger switch of the invention seen from a second visual angle.
Figure 5:
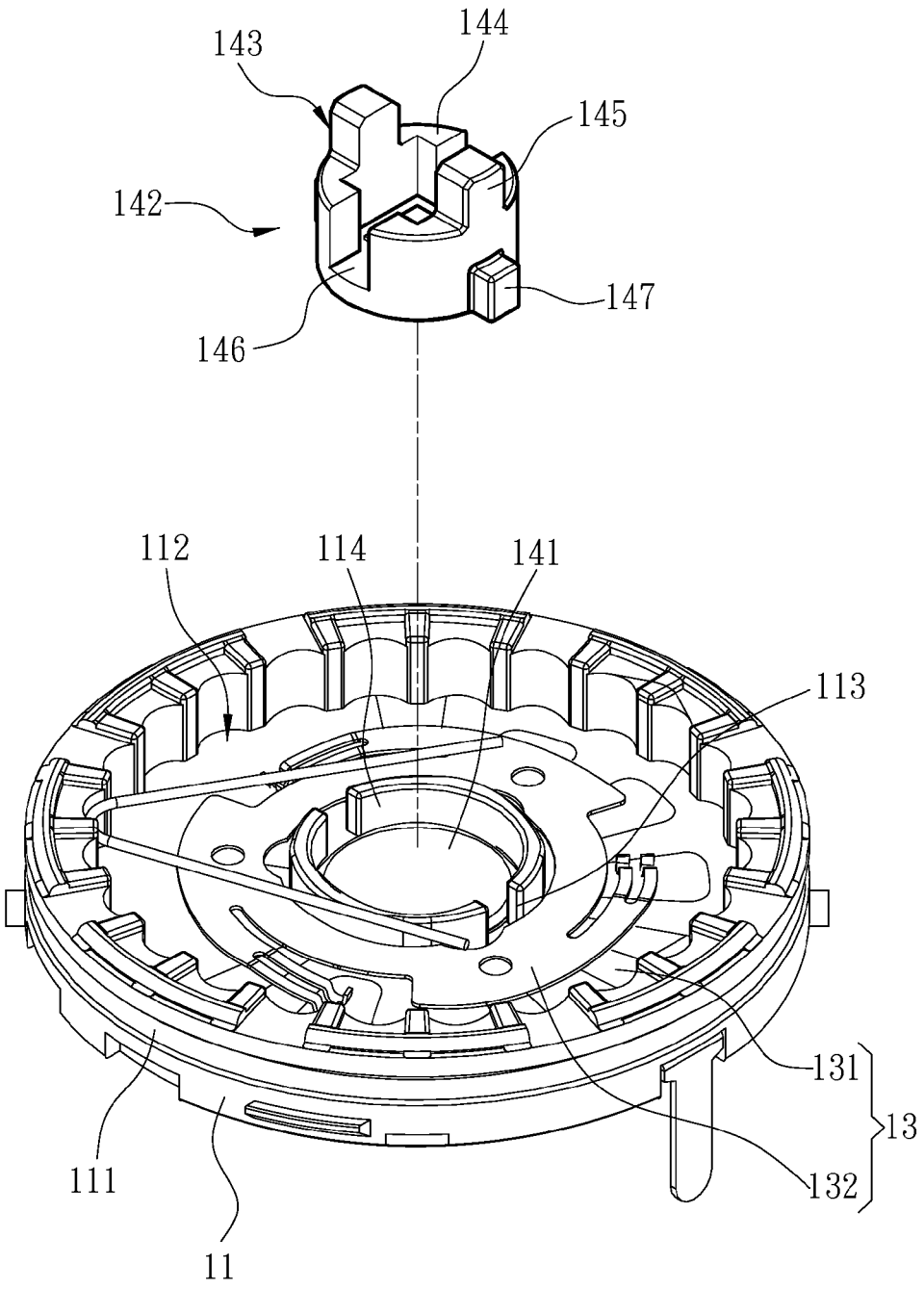
FIG. 5 is a fragmentary schematic view of an embodiment of the multi-command trigger switch of the invention.
Figure 6:
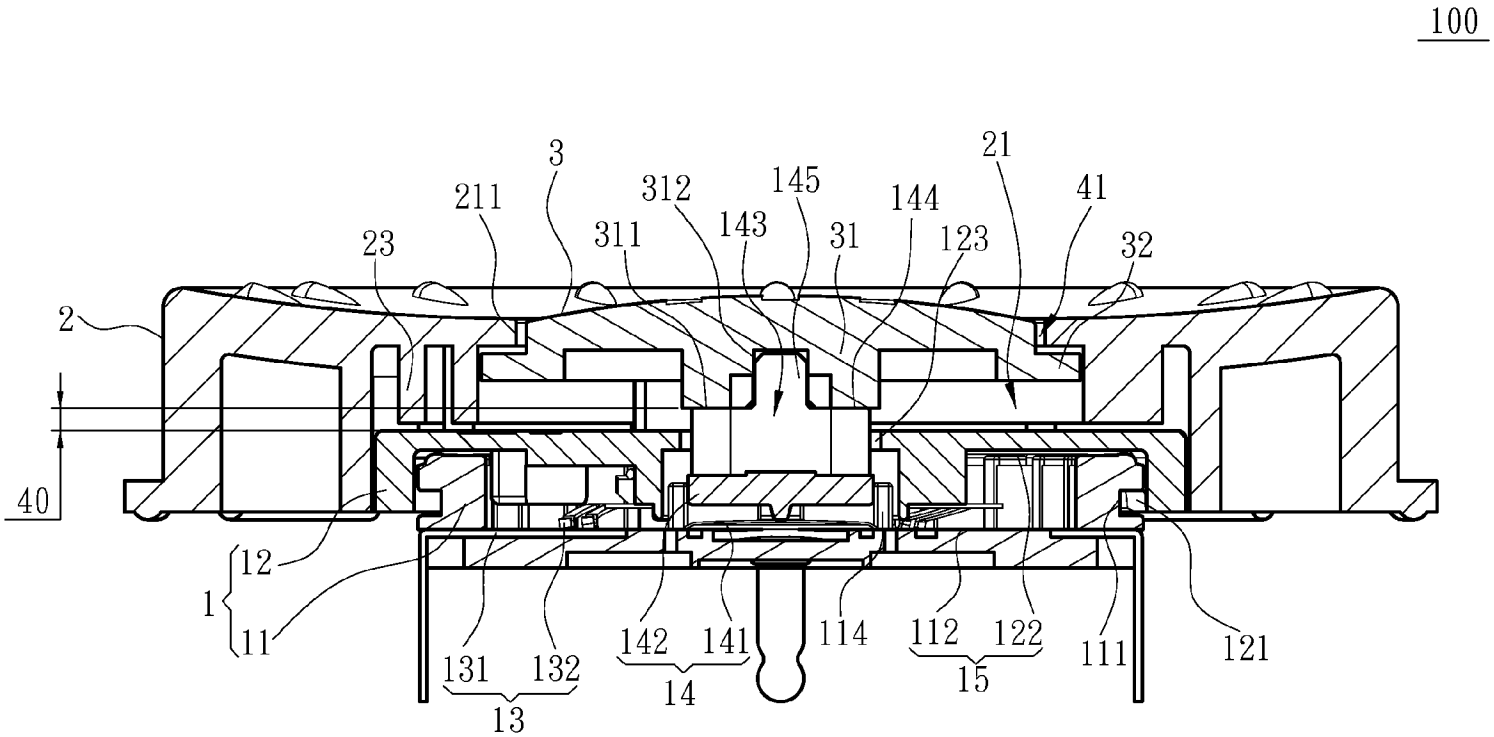
FIG. 6 is a sectional view of an embodiment of the multi-command trigger switch of the invention.
Figure 7:
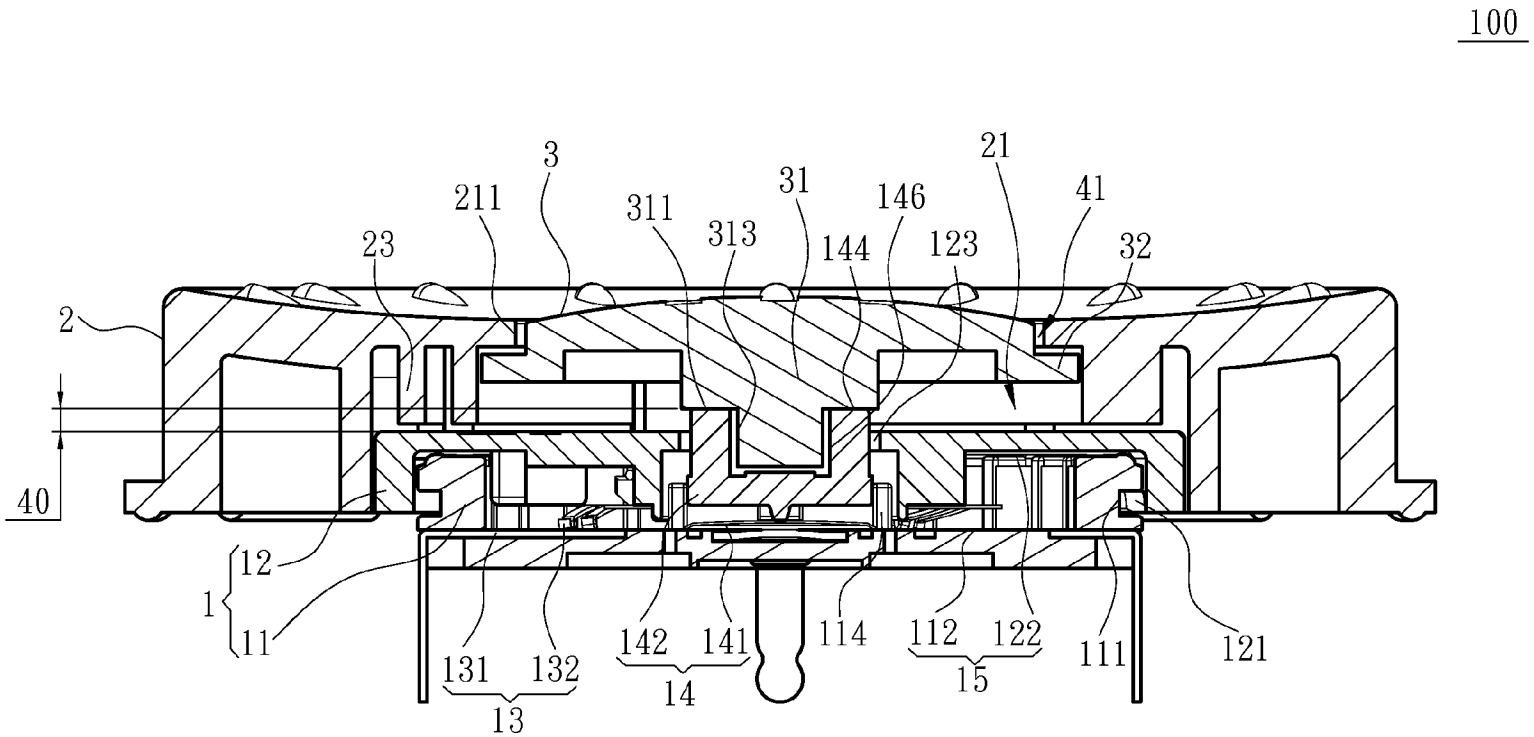
FIG. 7 is a sectional view of another embodiment of the multi-command trigger switch of the invention.

Based on the structure set forth above, the rotary casing 2 and the rotary switch 1 are coupled together to form a movement space 21 between them. The rotary casing 2 has an aperture 211 corresponding to the movement space 21. Furthermore, the rotary casing 2 and the rotary disc 12 have respectively a latch portion 22 and a latch trough 124 corresponding to each other to form a latch relationship. Upon receiving a force from a user, the rotary casing 2 can be rotated against the rotary switch 1, and the rotary casing 2, through the latch portion 22 and the latch trough 124, drives the rotary switch 1 moving on the swivel locus. In another embodiment the rotary casing 2 has an annular portion 23 surrounding the aperture 211 to define the movement space 21 with the rotary disc 12. On the other hand, referring to FIGS. 3 and 4, the trigger element 3 is coupled above the depressing trigger assembly 14 in the aperture 211, so that the user can depress the trigger element 3 and see marked notations on the trigger element 3 through the aperture 211. Furthermore, the trigger element 3 and the depressing trigger assembly 14 are interposed by a coupling portion 31 and a confining portion 143 that form a confining relationship to make the trigger element 3 unable to rotate against the rotary casing 2. Also referring to FIGS. 5 and 6, the confining portion 143 is located on the action strut 142 and includes an assembly plane 144 facing the trigger element 3 and an assembly boss 145 protruded from the assembly plane 144. The coupling portion 31 of the trigger element 3 includes an installation plane 311 in contact with the assembly plane 144 and a coupling recess 312 indented against the installation plane 311 to couple with the assembly boss 145. The assembly boss 145 and the coupling recess 312 mate each other. During assembly of the trigger element 3 and the depressing trigger assembly 14 the assembly boss 145 is aligned with the coupling recess 312 and precisely positioned therein so that the assembly plane 144 can be in contact with the installation plane 311 to finish assembly of the trigger element 3 and the depressing trigger assembly 14. Because the assembly boss 145 and the coupling recess 312 are formed in a protruding and indented relationship, the trigger element 3 cannot rotate freely against the depressing trigger assembly 14 but only move on the vertical locus against the depressing trigger assembly 14. Aside from the embodiment previously discussed, the protruding and indented relationship between the confining portion 143 and the coupling portion 31 can also be switched, with the confining portion 143 including an assembly recess 146 indented against the assembly plane 144, while the coupling portion 31 including a coupling boss 313 protruded from the installation plane 311 to couple with the assembly recess 146 as shown in FIG. 7. In addition to the aforesaid embodiment, in yet another embodiment the confining portion 143 can include the assembly boss 145 and the assembly recess 146 at the same time, with both of them staggered radially as shown in FIG. 3, and the coupling portion 31 includes the coupling recess 312 and the coupling boss 313 at the same time with both of them also staggered radially to be corresponding respectively to the assembly boss 145 and the assembly recess 146 as shown in FIG. 4. Moreover, the assembly boss 145, the assembly recess 146, the coupling recess 312 and the assembly boss 313 previously discussed can be formed in rectangular, but this is not the limitation of the invention, other geometrical shapes also can be adopted. In addition, the depressing trigger assembly 14 is protruded from the rotary disc 12 at a height 40 so that the rotary element 3 mounted onto the depressing trigger assembly 14 is not in contact with the rotary disc 12 of the rotary switch 1. On the other hand, the trigger element 3 and the rotary casing 2 also form an allowance 41 between them so that the rotary casing 2 does not drive the trigger element 3 while moving on the swivel locus. Furthermore, the trigger element 3 has a detent portion 32 on the rim thereof formed at a diameter greater than that of the aperture 211 to confine the trigger element 3 within the movement space 21.

As a conclusion, the multi-command trigger switch of the invention includes a rotary switch, a rotary casing and a trigger element. The rotary switch includes a base and a rotary disc coupled with the base and movable on a swivel locus against the base. The base and the rotary disc are interposed by a housing space to hold a rotary trigger assembly and a depressing trigger assembly. The rotary trigger assembly outputs a first trigger signal while moving on the swivel locus. The depressing trigger assembly is movable on a vertical locus to output a second trigger signal. The rotary casing and the rotary switch define a movement space to hold the trigger element. The base and the depressing trigger assembly are interposed by a positioning notch and a confining rib that form a confining relationship to confine the depressing trigger assembly to move on the vertical locus in the installation orifice. The depressing trigger assembly and the trigger element are interposed by a confining portion and a coupling portion that form a confining relationship to make the trigger element unable to rotate against the rotary casing. The invention thus formed provides improvement over the conventional multi-command trigger switch that has no confining on the trigger element and results in free self-rotation of the trigger element that causes confusion of the users in recognizing the marks on the trigger element.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A multi-command trigger switch, comprising:

a rotary switch including a base and a rotary disc coupled with the base and movable on a swivel locus against the base, the base and the rotary disc being interposed by a housing space to hold a rotary trigger assembly and a depressing trigger assembly, the rotary disc including an installation orifice communicating with the housing space and corresponding to the depressing trigger assembly for holding thereof, the rotary trigger assembly outputting a corresponding first trigger signal while the rotary disc is moving on the swivel locus, the depressing trigger assembly being independent from the rotary trigger assembly and movable on a vertical locus against the base in the installation orifice to output a second trigger signal;

a rotary casing which is coupled with the rotary switch to form an movement space therebetween and includes an aperture corresponding to the movement space and a latch portion to form a latch relationship with a corresponding latch trough formed on the rotary disc, the latch portion and the latch trough driving the rotary switch moving on the swivel locus when the rotary casing rotates under forces; and a trigger element which is coupled on the depressing trigger assembly at an upper side and held in the aperture, and movable in the movement space under forces to drive the depressing trigger assembly to move on the vertical locus;

wherein the base and the depressing trigger assembly include respectively a positioning notch and a confining rib corresponding to each other to form a confining relationship to confine the depressing trigger assembly to move on the vertical locus in the installation orifice, and the depressing trigger assembly and the trigger element include respectively a confining portion and a coupling portion to form a confining relationship therebetween to prohibit the trigger element from rotating against the rotary casing.

2. The multi-command trigger switch of claim 1, wherein the depressing trigger assembly includes a trigger reed located on the base and triggerable to generate the second trigger signal and an action strut located in the housing space corresponding to the trigger reed to couple with the coupling portion of the trigger element via the confining portion.

3. The multi-command trigger switch of claim 2, wherein the confining portion includes an assembly plane facing the trigger element and an assembly boss protruded from the assembly plane, the coupling portion including an installation plane in contact with the assembly plane and a coupling recess indented against the installation plane to couple with the assembly boss.

4. The multi-command trigger switch of claim 3, wherein the confining portion further includes an assembly recess indented against the assembly plane and staggered radially against the assembly boss, the coupling portion including a coupling boss protruded from the installation plane and staggered radially against the coupling recess to couple with the assembly recess.

5. The multi-command trigger switch of claim 2, wherein the confining portion includes an assembly plane facing the trigger element and an assembly recess indented against the assembly plane, the coupling portion including a coupling boss in contact with the assembly plane and protruded from the installation plane to couple with the assembly recess.

6. The multi-command trigger switch of claim 5, wherein the confining portion further includes an assembly boss protruded from the assembly plane and staggered radially against the assembly recess, the coupling portion including a coupling recess indented against the installation plane and staggered radially against the coupling boss to couple with the assembly boss.

7. The multi-command trigger switch of claim 2, wherein the positioning notch is located on a detent wall on the base corresponding to the depressing trigger assembly, the confining rib being located on the action strut.

8. The multi-command trigger switch of claim 1, wherein the depressing trigger assembly is protruded from the rotary disc at a selected height to support the trigger element without in contact with the rotary disc.

9. The multi-command trigger switch of claim 8, wherein the trigger element and the casing form an allowance therebetween so that the rotary casing does not drive the trigger element while moving on the swivel locus.

10. The multi-command trigger switch of claim 1, wherein the trigger element includes a detent portion located on the rim of the trigger element and formed at a diameter greater than that of the aperture so that the trigger element is confined within the movement space.

11. The multi-command trigger switch of claim 1, wherein the rotary casing includes an annular portion surrounding the aperture to collaborate with the rotary disc to define the movement space.

* * * * *